US005855042A

United States Patent [19]

Bruckner

[11] Patent Number: 5,855,042

[45] Date of Patent: Jan. 5, 1999

[54] DOOR HINGE ASSEMBLY

[75] Inventor: Sanford Bruckner, Bronx, N.Y.

[73] Assignee: Selby Furniture Hardware Company, Inc., Bronx, N.Y.

[21] Appl. No.: 739,878

[22] Filed: Oct. 31, 1996

[51] Int. Cl.[6] ..... A47B 81/00; E05D 7/08

[52] U.S. Cl. ..... 16/252; 16/257; 16/386; 312/293.2; 411/410; 411/904

[58] Field of Search ..... 16/252, 273, 278, 16/279, 37–39, 257, 262, 380, 254, 260, 261; 312/138.1, 293.2; 411/410, 908, 919

[56] References Cited

U.S. PATENT DOCUMENTS

| | | | |
|---|---|---|---|
| 1,894,034 | 1/1933 | Fieg | 411/410 |
| 2,824,464 | 2/1958 | Remington | 16/262 |
| 3,128,495 | 4/1964 | Tooth | 16/38 |
| 3,210,795 | 10/1965 | Fontana et al. | 16/43 |
| 4,319,794 | 3/1982 | Bachor | 16/257 |
| 4,863,330 | 9/1989 | Olez et al. | 411/908 |
| 5,697,746 | 12/1997 | Brown et al. | 411/410 |

FOREIGN PATENT DOCUMENTS

| | | | |
|---|---|---|---|
| 1020090 | 2/1966 | United Kingdom | 411/908 |

*Primary Examiner*—Chuck Y. Mah
*Assistant Examiner*—Donald M. Gurley
*Attorney, Agent, or Firm*—Malina & Wolson

[57] ABSTRACT

A door hinge assembly is provided which includes a mounting body with a pocket for receiving an edge of a door, a clamping mechanism positioned on and securing the mounting body to the door, a pin projecting upwards from the mounting body and a bushing for receiving the pin. The bushing is mounted in a recess of a door frame and preferably includes a series of fluted ribs along its outer wall. An annular ring projects inwardly from an inner wall of the bushing. A channel on the pin receives the annular ring and retains same within the bushing.

6 Claims, 1 Drawing Sheet

DOOR HINGE ASSEMBLY

BACKGROUND OF THE INVENTION

1. Field of the Invention

The invention concerns a hinge assembly which assists in the mounting of a door, especially an unframed glass door, into a casement.

2. The Related Art

A variety of mechanisms are known for attaching hinged doors to their cabinets. Glass doors are particularly difficult to mount. In many conventional methods, the known doors suffer from a disadvantage that they cannot be easily and quickly removed from their hinges and replaced with equal ease and speed, particularly by one person.

Some of these problems have been addressed in U.S. Pat. No. 4,319,7 (Bachor). Therein is disclosed a hinge part having a receiving pocket for enclosing an edge of a glass door, which is then further secured by a clamping screw threaded through a hole in a wall of the hinge part. Protruding vertically upward from the hinge part is a post insertable into a bushing. Two elastic members with locking projections are formed within the bushing. When the post is inserted between the elastic member, the locking projections lodge within an annular groove to lockingly secure the post to the bushing.

Although U.S. Pat. No. 4,319,794 has advanced the art, there still remain technical deficiencies. The locking projections of the bushing have limited vertical play within the annular groove of the post. Vertical adjustment of the door during emplacement becomes restricted. Moreover, the locking projections are subject to wear. The described clamping screw securing the glass door to the pocket of the hinge part also may be difficult to adjust, tighten and untighten.

Accordingly, it is an object of the present invention to provide a hinge assembly for mounting a door, especially an unframed glass door, into a structure opening such as a cabinet.

Another object of the present invention is to provide a hinge assembly for mounting a door, especially an unframed glass door, into a structure opening in a manner which allows ample vertical adjustment for proper placement.

Yet another object of the present invention is to provide a hinge assembly for mounting a door, especially an unframed glass door, into a structure opening which facilitates horizontal placement of the door.

Still another object of the present invention is to provide a hinge assembly for mounting a door, especially an unframed glass door, into a structure opening wherein the locking elements are less subject to wear.

Still a further object of the present invention is to provide a hinge assembly for mounting a door, especially an unframed glass door, in a structure opening wherein locking screws of the hinge assembly can be more readily tightened and untightened than previously possible.

Other objects of this invention will become apparent from consideration of the following summary, detailed discussion and drawings.

SUMMARY OF THE INVENTION

A door hinge assembly is provided which includes:

a mounting body having walls forming an opening for receiving an edge of a door;

at least one clamping mechanism positioned on one of the walls of the mounting body for securing the door to the body;

a pin with upper and lower ends, the pin being connected at the lower end to the mounting body, the pin including a pin head at the upper end, a uniformly diametered trunk being adjacent the lower end and a uniformly diametered neck forming a channel between the pin head and the trunk; and a bushing with outer and inner walls, the outer wall including a mechanism for engaging a recess in the body, the inner wall defining a cylindrical cavity for receiving the pin and including an annular ring projecting inward from the inner wall for snap seating of the pin within the channel.

Preferably, the mechanism on the bushing for engaging the recess is a plurality of vertically oriented ribs in a fluted arrangement. Unlike annular rings around prior art bushings, the vertical fluted arrangement facilitates the removal of residual sawdust within the drilled holes of the recess. Fluting permits the sawdust to enter the spaces between the vertical ribs thus contributing to the holding power within the recess while providing for correct seating therewithin.

The clamping mechanism is embodied in screw form. Preferably, these screws are made of a pressed fiber so as not to mark the glass while making a secure fitting. Furthermore, the screw is molded with two flat sides parallel one another and cross-slots on the head. Cross-slots on the head of the screw enable tightening by hand, by Phillips screwdriver or by flat-blade implement.

BRIEF DESCRIPTION OF THE DRAWING

The above objects, features and advantages of the present invention will more fully be appreciated through the following detailed discussion, reference being made to the drawing in which.

DETAILED DESCRIPTION

Figure 1:
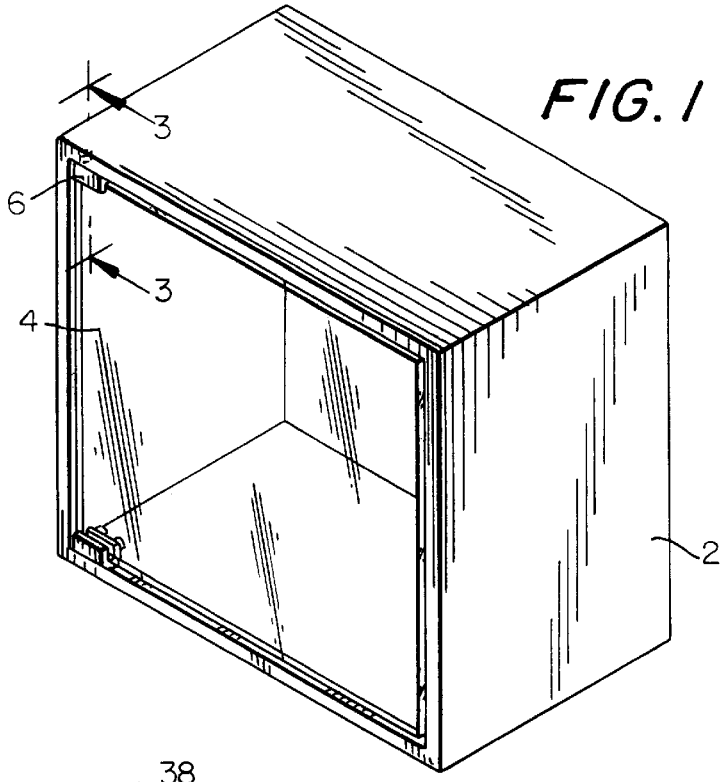
FIG. 1 is a plan perspective view of a cabinet with hinged glass door.

FIG. 1 illustrates a furniture cabinet having a cabinet body 2 and a glass door 4. A hinge assembly 6 is fitted to an upper pivoting edge of the glass door.

Figure 2:
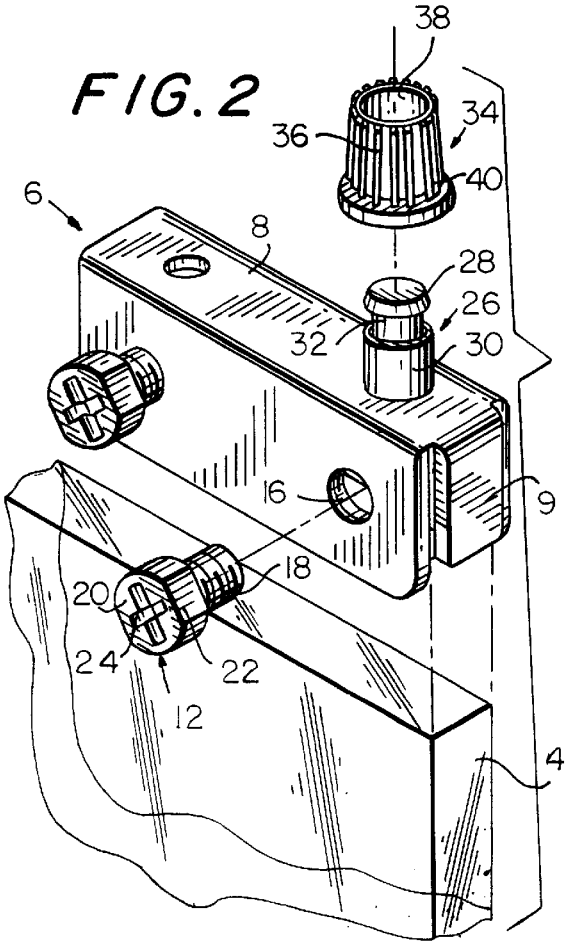
FIG. 2 is an expanded view of the hinge assembly with a separated screw and bushing over a corner of the glass door, the latter being partially drawn.
Figure 3:
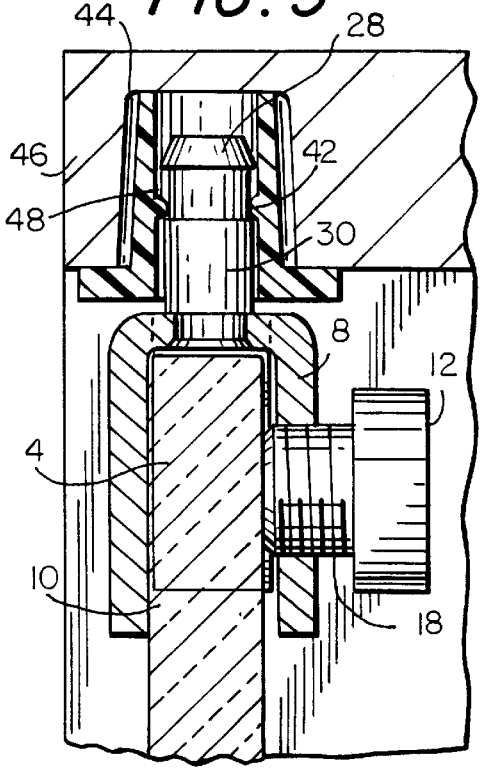
FIG. 3 is a cross sectional view taken along line 3—3 of FIG. 1.

FIG. 2 illustrates the several components of the door hinge assembly 6. These include a mounting body 8 having walls forming a pocket 10 for receiving an edge of the door. An end wall 9 is formed unitarily with and positioned orthogonal to the walls forming pocket 10. Additionally, the hinge assembly includes at least a pair of screws 12 serving as a clamping mechanism. Screws 12 threadably engage a female threaded aperture 16 within a side wall of the mounting body 8. Besides the male threads surrounding a cylindrical engagement body 18, the screw includes a head 20 with two opposite parallel sides 22 which are flat. Each of the screws are formed of pressed fibers molded together. The screws function to fasten the glass door to the hinge thereby rendering a secure fitting. The flat sides of the screw and cross-slots 24 enable tightening either by hand, by Phillips screwdriver or by flat-blade screwdriver.

A male pin 26 having upper and lower ends is connected at the lower end to the mounting body 8. A pin head 28 is located at the upper end of the pin, as a uniformly diametered trunk 30 adjacent the lower end and a uniformly diametered neck 32 forming a channel between the pin head 28 and trunk 30. The hinge assembly further includes a bushing 34 having outer and inner walls 36, 38. A series of vertically oriented ribs 40 provide a fluted arrangement along the outer wall 36 of the bushing. The bushing on inner wall 38 includes an annular ring 42 projecting inwards.

Installation of the hinge assembly involves placing the assembly along an edge of the glass door so that the door 4 is seated within the pocket 10. End wall 9 functions as a stop mechanism assisting in the horizontal placement of the door. Screws 12 are then tightened to secure the door to the mounting body. Bushing 34 is then anchored into a recess 44 of a door frame 46 on the cabinet body 2. Vertical ribs on the bushing in contrast to annular rings allow removal of any residual sawdust within the recess. The fluted arrangement permits the sawdust to enter spaces between the ribs thus contributing to the holding power of the bushing.

Once the hinge assembly is mounted onto the glass door, the door is positioned within the door frame and pin 26 is upwardly inserted within the bushing. Pin head 28 is forced past the annular ring 42 within the bushing to snap seat the assembly. Channel 48 between the pin head and trunk permits the pin 26 a certain amount of vertical play for adjustment.

While the invention has been illustrated and described in a particular embodiment, it is not intended to be limited to the details shown, since various modifications and structural change may be made without departing in any way from the spirit and purview of this invention.

What is claimed is:

1. A door hinge assembly comprising:

a mounting body having walls forming an opening for receiving an edge of a door;

at least one clamping means positioned on one of the walls of the mounting body for securing the door to the body;

a pin with upper and lower ends, the pin being connected at the lower end to the mounting body, the pin including a pin head at the upper end, and a uniformly diametered trunk being adjacent the lower end and a uniformly, reduced diametered neck forming annular channel between the pin head and the trunk; and a bushing with outer and inner walls, the outer wall including means for engaging a recess in a doors frame, the inner wall defining a cylindrical cavity for receiving the pin and including an annular ring projecting inward from the inner wall for snap seating of the annular ring within the annular channel, the annular channel having an axial length substantially greater than a axial length of the annular ring permitting the pin an amount of vertical play for adjustment.

2. The door hinge assembly according the claim 1 wherein the means for engaging the recess comprises a plurality of vertically oriented ribs.

3. The door hinge assembly according to claim 1 wherein the clamping means is a screw comprising a head with at least two flat sides parallel one another.

4. The door hinge assembly according to claim 3 wherein the head is formed with a pair of cross slots.

5. The door hinge assembly according to claim 1 wherein the clamping means is a screw formed of pressed fibers molded together.

6. The door hinge assembly according to claim 1 wherein the mounting body further comprises an end wall orthogonal to a pair of parallel side walls forming the opening.

* * * * *